US005383674A

United States Patent [19]

Cann et al.

[11] Patent Number: 5,383,674

[45] Date of Patent: Jan. 24, 1995

[54] ICE SKATE BLADE ASSEMBLY AND REMOVEABLE RUNNER FOR SAME

[76] Inventors: Brian G. Cann, 239 Holly Dr., Chalfont, Pa. 18914; Richard C. Hampton, R.R. No. 1, King City, Ontario, Canada, L0G 1K0

[21] Appl. No.: 957,698

[22] Filed: Oct. 7, 1992

Related U.S. Application Data

[62] Division of Ser. No. 749,265, Aug. 23, 1991, Pat. No. 5,332,242.

[30] Foreign Application Priority Data

Feb. 24, 1989 [CA] Canada ..... 592006

[51] Int. Cl.[6] ..... A63C 1/30

[52] U.S. Cl. ..... 280/11.18

[58] Field of Search ..... 280/7.13, 11.12, 11.17, 280/11.18

[56] References Cited

U.S. PATENT DOCUMENTS

| | | | |
|---|---|---|---|
| 29,116 | 7/1860 | White et al. . | |
| 38,829 | 6/1863 | Johnson . | |
| 1,658,093 | 2/1928 | Nygaard | 280/11.18 X |
| 1,749,298 | 3/1930 | Orafsik . | |
| 2,108,128 | 2/1938 | Kinney . | |
| 2,130,641 | 9/1938 | Grubb . | |
| 2,150,964 | 3/1939 | Dornseif . | |
| 2,242,870 | 5/1941 | Prosey . | |
| 2,988,369 | 6/1961 | Rebicek . | |
| 3,026,118 | 3/1962 | Paré280 | 7.13 X/ |
| 3,947,050 | 3/1976 | Isely . | |
| 4,074,909 | 2/1978 | Baikie . | |
| 4,131,288 | 12/1978 | Wilson . | |
| 4,139,209 | 2/1979 | Humphreys . | |
| 4,218,069 | 8/1980 | Baikie . | |
| 4,223,900 | 9/1980 | Olivieri . | |
| 4,379,563 | 4/1983 | Arsenault . | |
| 4,932,675 | 6/1990 | Olson et al. . | |
| 5,088,749 | 2/1992 | Olivieri . | |
| 5,248,156 | 9/1993 | Cann et al. | 280/11.12 X |
| 5,332,242 | 7/1994 | Cann et al. | 230/11.18 |

FOREIGN PATENT DOCUMENTS

| | | | |
|---|---|---|---|
| 163636 | 7/1915 | Canada . | |
| 166373 | 11/1915 | Canada . | |
| 239918 | 5/1924 | Canada . | |
| 380906 | 4/1939 | Canada . | |
| 386541 | 1/1940 | Canada . | |
| 428202 | 6/1945 | Canada . | |
| 637948 | 3/1962 | Canada . | |
| 1053278 | 4/1979 | Canada . | |
| 1072944 | 3/1980 | Canada . | |
| 269583 | 3/1913 | Germany . | |
| 724488 | 7/1942 | Germany . | |
| 759294 | 5/1943 | Germany . | |
| 313056 | 12/1933 | Italy . | |
| 223321 | 9/1942 | Switzerland . | |
| 3105 | 6/1911 | United Kingdom . | |
| 953308 | 3/1964 | United Kingdom | 280/11.18 |
| 2050845 | 1/1981 | United Kingdom . | |
| 8400501 | 2/1984 | WIPO | 280/713 |
| 9009817 | 9/1990 | WIPO . | |

*Primary Examiner*—Brian L. Johnson

*Attorney, Agent, or Firm*—Fay, Sharpe, Beall, Fagan, Minnich & McKee

[57] ABSTRACT

An ice skate runner which may be removeably secured to a blade holder which forms part of an ice skate blade assembly. The runner is formed as a thin replaceable flexible strip arranged to be secured to said holder, The top surface of the strip has a configuration which is complementary to the lower surface of the holder so as to prevent lateral displacement of the strip with respect to the holder. Attachments are provided in the front and rear of said holder to hold the strip in place and to create tension along the entire length thereof.

13 Claims, 3 Drawing Sheets

ICE SKATE BLADE ASSEMBLY AND REMOVEABLE RUNNER FOR SAME

This is a divisional application of Ser. No. 749,265 filed Aug. 23, 1991, now U.S. Pat. No. 5,332,242, which is a continuation-in-part application of Ser. No. PCT/CA90/000,063 filed Feb. 23, 1990 now abandoned.

FIELD OF THE INVENTION

This invention relates to ice skates and more particularly to an ice skate blade assembly and to a replaceable runner for same.

DESCRIPTION OF THE PRIOR ART

Various attempts have been made to provide replaceable blades for ice skates. However, these prior art attempts have provided replaceable blades which have various drawbacks.

For example, the replaceable blades described in the following patents are secured in place with bolts, screws or the like, must therefore be rigid and require the use of appropriate tools to proceed with their replacement: Canada 239,918 (Beals et al.); Canada 386,541 (Grubb); Canada 1,053,278 (Wilson); Canada 1,072,994 (Baikie); U.S. Pat. No. 1,749,298 (Orafsik; U.S. Pat. No. 2,242,870 (Prosey) and U.S. Pat. No. 4,379,563 (Arsenault).

Canadian patent 428,202 (Howard) discloses a rigid replaceable blade having a rod shaped top portion which is slidable in a slot in the holder.

U.S. Pat. No. 2,988,369 (Rebicek) describes a replaceable blade of square cross section which has four (4) skating edges. It is held in place by being snapped into a groove.

U.S. Pat. Nos. 2,150,964 (Dornseif) and 4,218,069 (Baikie) disclose replaceable blades which are attached to the front portion of the holder by a hook and near the rear portion by a tension screw. The blades extend only over that part of the holders which actually contacts the ice and must be relatively rigid as they must be formed by stamping. There is no upwardly extending end portion as with this present design so that the portion behind the tension screw is not tensioned. Furthermore, in the Dornseif design the blade strip is engaged by a screw part which straddles a rear end portion of the blade strip rib, and which is connected to an enlarged portion of this rib by means of some kind of cross pin. The need to provide an enlargement of the blade strip rib would be a significant drawback of this prior design, Since it would mean that the blade strip could not be thin or be produced by a simple rolling or extruding procedure. By contrast, in the present invention, neither the front or rear fixing arrangements for the blade strip require any enlargement of the blade strip nor is any part required to be permanently connected to the blade strip. Thus, the blade strip of this invention can be made by simple rolling or extrusion (if the material is suitable for extrusion), followed by removal of the rib at the front and rear end portions, and then forming the front end and the rear end into the appropriate configurations.

Also, the blade strip of this invention can be quite narrow, for example the strip need be no wider than 3/16 inches (4.8 mm) and no deeper (excluding the rib) than ⅛ inches (3.17 mm); the rib itself will normally be less than 1/16 inches (1.6 mm) in both height and width.

By contrast, in Dornseif the rib must be strong enough to receive all the tension applied by the screw means, which suggests that the overall dimensions of the Dornseif strip are much more than with the present invention, so that the latter strip would lack the flexibility of applicant's strip. Furthermore, if the Dornseif strip had the flexibility associated with the strip of this invention, the part of Dornseif's strip rear of the fixing means would tend to flap.

U.S. Pat. No. 3,947,050 (Isely) describes a removable blade which is also attached to the front portion of holder by a hook. However, the blade has a vertical thickness such as to resiliently yield only to a minor degree of flexing about a transverse axis. The curvature of the holder is greater than that of the blade such that the ends of the blade must be flexed upwardly on assembly so that the blade is resiliently self biased into mating relationship to the holder. A worm gear disposed at 90° in relation to the ice surface is used to create such bias by pulling the rear portion of the blade towards the holder. In contrast to the blade strip of this invention, Isely's must be strong and rigid enough to resiliently "yield to a minor degree of flexing" (C.2, L49–51) while maintaining "all parts of the blade securing means under load so as to prevent any free play of parts" and acting "somewhat as a lock washer" (C.4, L40–44). Indeed, the blade is held in place by the resiliently reaction of the blade to being flexed up by the, worm gear. The strip of this invention must be longitudinally resilient but is not required to be resilient about a transverse axis.

German patentschrift 269,583 (Heine) discloses a thin replaceable sheet metal running edge which is pressed into a V-shaped section in the ice contacting area and which remains flat in the upwardly extending rear portion. Using a softer steel in order to make the part function as shown, the blade strip would be unacceptably soft and would not hold an edge nor stand up to impact loads which would fold the sheet metal into the groove or otherwise render the blade strip un-usable. The disclosed configuration is not adapted to work with today's harder steels, which are used in the manufacture of ice skate blades. Indeed, with today's harder steels, it would be impossible to achieve tension in the strip while creating a 180° turn at d-e. Furthermore, if such were possible, there would remain the serious difficulty resulting from the fact that harder steels tend to be brittle and could result in the breakage of the blade strip if the skate blade hits a hard obstacle or was hit by same.

SUMMARY OF THE INVENTION

The purpose of this invention is to provide an ice skate blade assembly comprising a replaceable runner and a holder therefor having substantial improvements over conventional ice skate blades as well as existing disposable and/or replaceable skate blades.

This invention provides a stable blade holder with a replaceable runner or strip providing the skating edges, which can be attached to the holder or removed readily and quickly.

This replaceable runner system provides many advantages including the convenience of sharp edges on the runner which can be installed without tools, at any time and at any place.

The effective blade height and shape will not be altered by installing a new runner. With conventional skates, the shape will change and the height will decrease with each sharpening.

The rocker, or front to back shape of the blade can be modified to the skater's preference by grinding the holder's bottom edge. The replacement runner is then tensioned tightly across this edge and conforms to its shape.

Significant weight savings may be realized with this runner system as a large section of conventional blades, which is required to allow for future sharpening, is no longer needed. If required, lateral stability may be enhanced by providing a reinforced section extending along the lower edge of the holder.

Such replaceable runners may be sold pre-sharpened with a consistent, highly polished quality sharpness, and packaged in pairs. The runners should provide a sharpness which lasts at least as long as that of conventional skate blades. In order to accommodate the various sizes of ice skate boots and their corresponding blade lengths, the blade holder and runners also have to be produced in corresponding lengths.

This runner system offers these benefits and advantages while maintaining the styling and skating characteristics found in today's ice skates.

The present invention thus provides an ice skate blade assembly having a holder. The holder has a front end, a runner supporting portion and a rear end. The holder is configured so as to be able to carry a replaceable runner formed as a flexible strip arranged to be secured to the holder. The runner has a runner front end, an ice contacting portion and a runner rear end; the runner front end, the ice contacting portion and the runner rear end define a runner length. The assembly also has a front attachment means for releasably securing the runner front end to the front end of the holder. The assembly is characterized in that the assembly comprises an eccentric lock means for releasably securing the runner rear end to the rear end of the holder. The eccentric lock means comprises urging means having a first pivot axis and a second pivot axis, the second pivot axis being disposed eccentrically of the first pivot axis, the urging means being connected to the holder such that the urging means is pivotable about said first pivot axis, and second hooking means for releasably engaging a first hooking means when said first hooking means is connected to an upwardly extending terminal end part of said runner rear end.

The eccentric lock means has a lock configuration wherein the second hooking means is able to be releasably maintained in a locking over-center position relative to the first pivot axis such that a said runner is longitudinally tensioned along the runner length, and an unlock configuration wherein the first and second hooking means are disengageable.

The eccentric lock means is displaceable between the lock and unlock configurations by displacing the urging means about the first pivot axis between a respective lock and unlock position. The second hooking means is connected to the urging means so as to be pivotable about the second pivot axis and so as to be urgeable to and from said locking over-center position when said urging means passes between the said lock and unlock positions.

The assembly may of course include a runner as described above. The runner and runner supporting portion may have mating tongue and groove means interlocked along the ice contacting portion.

According to one aspect of the invention, in an ice skate blade assembly of the type described, the blade holder includes a main upper portion formed of plastics and a lower reinforcement portion. The lower reinforcement portion is formed of material stronger than the plastics of the upper portion and also provides a locating surface for the runner. The lower holder portion, when the assembly includes a runner, is disposed between the runner and the upper holder portion. In accordance with another aspect of the invention, in an ice skate blade assembly of the type described, the urging means may comprise a latch lever displaceable about the first pivot axis between the lock and unlock positions, and the second hooking means may comprise a draw hook. The draw hook has an outer end hook for releasably engaging the first hooking means; the draw hook is also provided with an inner end connected to the latch lever such that the draw hook is pivotable about the second pivot axis. The arrangement is such that the runner can be secured by engagement of the draw hook outer end with the hooking means of the runner and by rotation of the latch lever to a closed position at which the draw hook is over-center relative to the lever pivot axis.

In accordance with another aspect, the present invention provides an ice skate blade assembly having a holder carrying a replaceable runner formed as a flexible strip arranged to be secured to the holder, said runner having a bent over front end portion engageable with the front end of said holder and having an ice contacting portion and a rear end portion, wherein said rear end portion of the runner is substantially straight, extends upwardly and has a screw threaded section, and wherein a rear end of the blade holder has an upwardly extending bore suitable for receiving said rear end runner portion and which bore is interrupted by a recess open to the rear of the blade holder; the assembly further comprising a nut which when threaded on to said screw threaded section, is capable of being rotated in the recess for tightening the runner on the blade assembly.

In accordance with the present invention, an ice skate blade assembly may be configured such that the angle formed between the longitudinal axis of the hooking means and the tangent of the ice contacting portion may, if desired, be greater than 60° and less than 90°.

A runner for an ice skate formed as a thin strip of metal arranged to be secured to a blade holder, said runner having an inwardly bent over front end portion for engaging in a recess in the front of the blade holder, and having, at the end of an upwardly extending rear end portion, a hook configuration with a recess open to the rear of the runner.

Such a runner is provided with means to preserve lateral stability. Such means may be a central upwardly projecting rib for locating in a groove in the blade holder.

The dimensions of said runner when made of high carbon steel, excluding the rib, may be in the order of up to 4 mm wide and up to 3 mm deep, (preferably, in the order of ⅛ inches (3.0 mm) wide and 1/16 inches (1.6 mm) deep), to allow a good proper lateral stiffness while maintaining longitudinal resiliency.

BRIEF DESCRIPTION OF THE DRAWINGS

The invention will be further described with reference to a preferred embodiment shown in the drawings, and in which.

DESCRIPTION OF A PREFERRED EMBODIMENT

The major parts of the blade assembly, namely the holder, the runner or blade strip, the front holding means and the rear holding means, will now be described in detail.

The Holder

The holder 10 is similar in style and purpose to a conventional skate blade holder which attaches to the sole of the skate boot and holds a blade. Although in this invention no blade as such is required, the term "blade holder" or "holder" will be used herein for part 10 as a matter of convenience.

The holder 10 is of a molded plastic composition providing proper attachment to the skate boot. The preferred material is Dupont "Zytel ST 801" (trade mark), a nylon impregnated resin.

In the front of the holder there is a hole 12 or suitable recess to accommodate the front end of the blade strip 14. There is also provision on the back of the holder for attachment of the retaining mechanism indicated generally at 16 and described further below.

Running the length of the underside of the holder, and extending up front and rear end portions of the blade holder, is a square-sectioned groove with which the blade strip mates.

This groove is deeper than a protrusion on the blade strip (described below). This ensures that the blade strip will be centered by vertical sides on the protrusion acting against sides of the groove, and ensures that the weight bearing edges of the strip are properly located at the sides of the groove. The groove is also deep enough to allow material to be removed from the lower surface of the holder when adjusting its shape, while still providing a clearance between the bottom of the groove and the protrusion on the blade strip.

Figure 3:
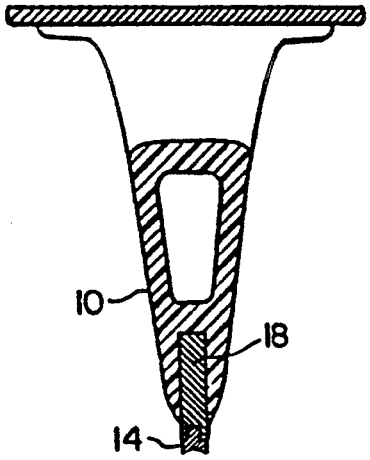
FIG. 3 is a cross-sectional view on line 3—3 of FIG. 2.
Figure 3A:
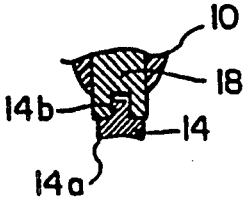
FIG. 3A is an enlarged detail of the parts shown in FIG. 3.

In order to provide the lateral strength required for ice skates, a reinforcement section is preferably moulded into a plastic along this lower edge and may contain the groove. A possible form of reinforcement bar is indicated as 18 in FIG. 3; this may be made of a material (e.g. carbon steel, carbon fiber, etc.) which provides the proper amount of rigidity without being brittle and which is considerably stronger than the plastic material of the main part of the holder.

The Runner or Blade Strip

The runner 14, which is the heart of the system, is a thin strip which runs the length of the lower edge of the holder 10 and up the rear end thereof. The blade strip is strong enough to hold the sharp lower edges **14*a*** while being flexible enough to conform to the shape of the blade holder when suitably tightened or tensioned by the retaining mechanism at the back of the holder. The strip can be made of any suitable material (i.e. stainless steel, carbon steel, engineering plastic, etc . . . ) which has these characteristics and will hold a sharp edge when skated upon. In a preferred embodiment, this strip is in the order of ⅛ inch (3.17 mm) wide by 1/16 inch (1.6 mm) deep, and is formed of high carbon steel.

The top of the blade strip has a protrusion or rib **14*b* running the length of the strip which fits into the corresponding square-sectioned groove in the holder referred to above, providing lateral stability. A clearance space is provided between the top of rib 14*b* and the bottom of the groove, so that the surfaces of the strip beside rib 14*b*** are always in firm contact with the bottom of the holder. The protrusion may have various configurations as long as laterally the blade is secure and remains flat to the holder; preferably however it is in the form of a 1 mm square-sectioned rib.

The Front Holding Means

In this embodiment, the front end of the blade strip is inwardly bent back toward the skate to provide a hook with rearwardly extending spigot which engages the hole 12 at the front of the holder. This hook is sufficiently resilient to provide relief for over-tightening when installed while maintaining adequate tension (which will vary according to the material used for the runner) on the strip in other situations when the runner may be loosened or tightened.

The Rear Holding Means

The back end of the blade strip is first bent up to provide an upwardly extending part 20, and is then bent outwardly in a tight radius so as to provide a hook configuration 22 with a rearwardly facing recess for the latching mechanism to attach to. This hook configuration is also resilient and also reacts similarly to the front hook in over tightening or loosening situations. The same effect could be attained with a number of different hook attachments such as "teeth" which engage with corresponding "teeth" on a latching mechanism at the proper height or a stamped "T" type end picked up by two forks on a latch.

The latching mechanism 16 at the back of the holder is of suitable conventional commercial type which provides sufficient tension and travel to hold and firmly "lock" the blade strip in place. Excessive tension or travel are not required to properly secure the blade strip to the blade holder. The exact tension required will vary according to the material used for the runner.

Figure 4:
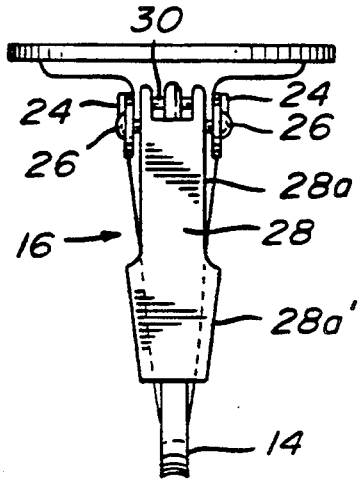
FIG. 4 is a rear view of the holder, showing a latch mechanisms.
Figure 5:
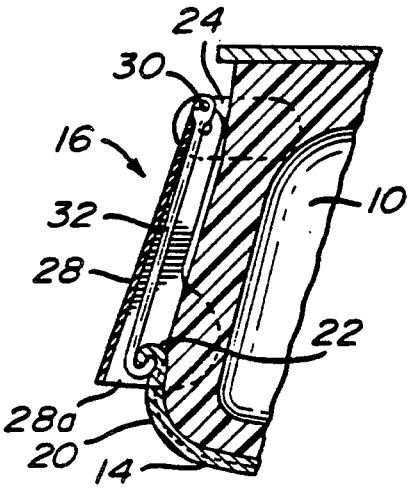
FIG. 5 is a longitudinal section of the rear part of the holder shown in FIG. 4.

As shown in FIGS. 4 and 5, the preferred latch mechanism includes two strap parts 24 secured to the rear of the holder by rivets so as to define rearwardly extending lugs which carry rivet members 26 providing pivots holding the flanges 28a of a channel form latch lever 28. The lever extends rearwardly of the pivots 26 in an unlatched condition and is pivotable downwards into the latched condition, shown in FIG. 5, where extensions 28a' of the lever flanges 28a enclose the rear end of the blade strip. The inner end of lever 28, beyond pivots 26, carries a cross pin 30 which pivotally mounts the inner end of draw hook 32. The outer end of draw hook 32 has a hook portion engageable with the hooking means 22 when the pin 30 is lowered by swinging out the latch lever. Closing the lever into the FIG. 5 position causes the axis of the draw hook 32 to move over-center relative to pivots 26 so that tension in the blade strip holds the lever in this position. An intermediate part of the draw hook has screw means for adjusting its length, to accommodate variations in the blade strip.

As may be appreciated from the above, the front and rear attachment means cooperate to longitudinally tension the runner along its entire length; the hooking means attached to the upwardly extending runner rear end matingly engages with the hook end of the draw hook such that on rotation of the latch lever to a closed or lock position, the runner rear end may pivot about a transverse axis.

The flanges 28a provide an integral cover to round out the heel or back of the blade system. This protects the latch from being damaged if hit as well as acting as safety protection for objects which may come in contact with the back of the skate blade.

A spring loaded draw hook may alternatively be used in the latch mechanism to maintain suitable tension in overtightening or loosening situations.

The draw hook 32 matingly engages with said hooking means 22 whereby said rear end will pivot about a transverse axis during the operation of the draw hook 32.

In a modification of the invention, the rear of the blade strip has the rear upwardly extending part terminating in a screw threaded portion which is engaged by a nut held in a recess in the rear of the blade holder. The screw threaded portion is provided by partial threads on the opposite sides of the upwardly extending part from which the rib 14b has been removed.

Figure 1:
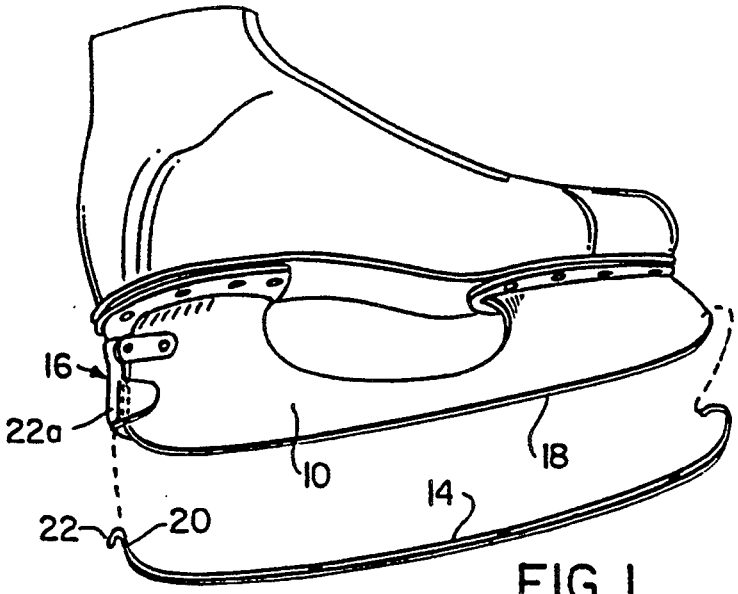
FIG. 1 is a perspective view of an ice skate with a runner shown separated.
Figure 2:
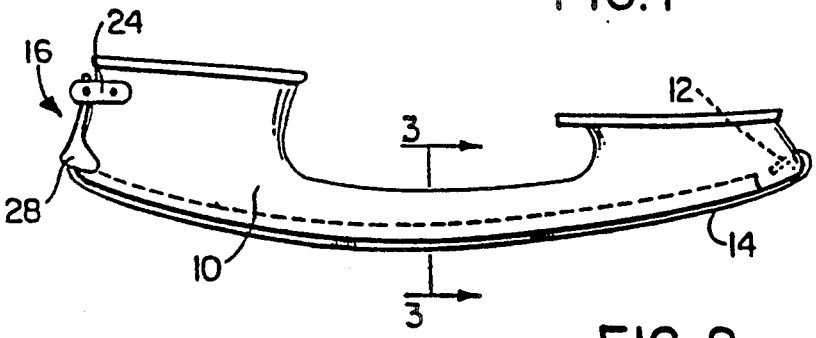
FIG. 2 is a side view of a blade assembly, with the runner in place.
Figure 6:
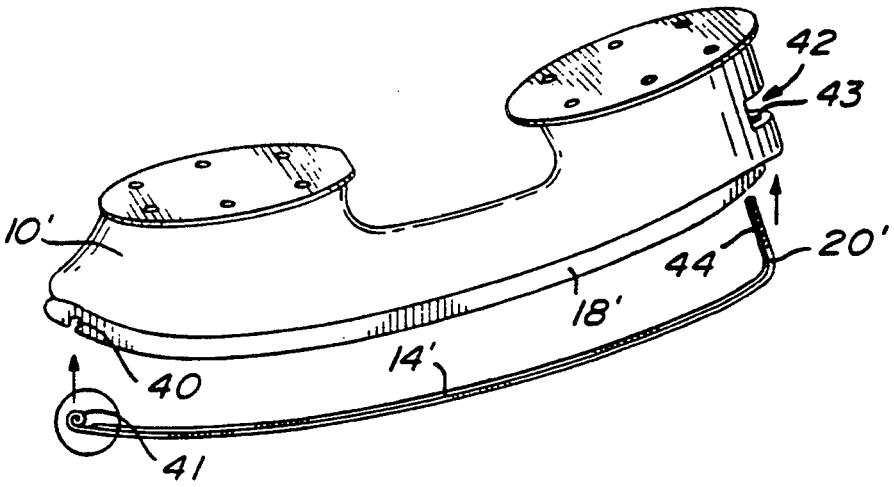
FIG. 6 shows a view of the modified blade holder with the modified blade strip shown separated.

Referring to FIGS. 1 and 6 the modified holder is similar to holder 10 described above in being made of moulded plastic construction and in having a lower reinforcement section 18' (similar to section 18 described above) and which is formed of material stronger than the plastics material of the main holder part 10'. The modified holder differs from the first embodiment in that:

(a) The front of part 18' has (instead of hole 12) a recess 40 the interior surfaces of which are generally cylindrical and surround a normally horizontal axis, these surfaces being suitable for retaining a tight roll 41 of the material forming the blade strip which lacks the rib 14b which runs along the major length of the blade strip, as in the first embodiment. The roll of material 41 can be inserted by sideways sliding into the recess 40 which has a suitable bottom opening allowing the blade strip material to pass through while resiliently retaining this roll. This roll acts as an anchor, in similar manner to the hook of the first embodiment, but allows somewhat more resilience since the roll can unwind slightly like a spring; this accommodates variations in the holder shape and allowing for its adjustment by grinding.

Figure 6A:
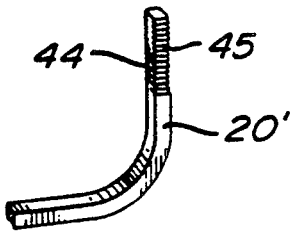
FIG. 6A shows an enlarged view of the rear end of the modified blade strip.
Figure 6B:
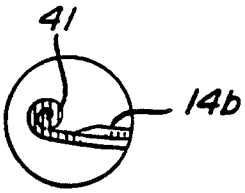
FIG. 6B shows an enlarged view of the spiral spring front end of the blade strip in FIG. 6.
Figure 7A:
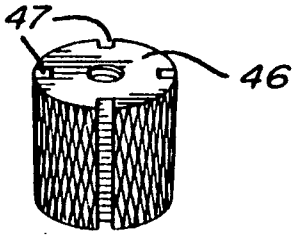
FIG. 7A shows an enlarged view of a nut used to hold the blade strip.
Figure 7:
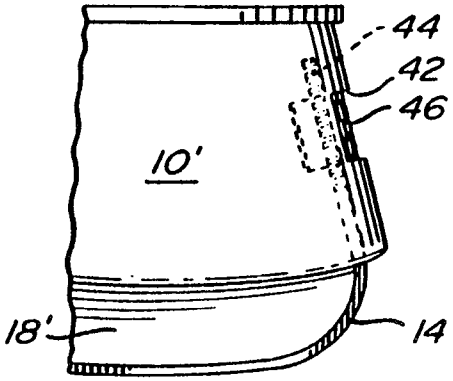
FIG. 7 shows an enlarged view of the rear end portion of the modified blade holder with blade strip attached.

(b) The rear end of the blade holder has no latch means; instead it is provided with a recess 42, shown in FIG. 7, which is open to the rear of the blade holder and communicates with a bore 43 extending up inside the rear end of the blade holder, roughly parallel to its rear edge, and which is interrupted by recess 42. This bore 43 is suitable for receiving an upwardly extending part 20' of the blade strip 14', which part (like the front portion) lacks the rib 14b. The angle between said upwardly extending part 20' and the tangent of the central portion of the blade strip 14' may, if desired, be greater than 60° and smaller than 90°. The lateral sides of an end portion of part 20' are provided with screw threads portions 45 as shown in FIG. 6A, and when part 20' of a blade strip has been passed into the bore 43, a nut 46 can be inserted into recess 42 and threaded onto threads 45 to pull the blade-strip into place. This nut 46 has a knurled exterior and side slots 47 which allow the nut to be tightened firmly by insertion of an implement or coin. This tightening acts like a latching device in that it draws the blade strip into place on the blade holder and ensures that it is tensioned and bedded down tightly in the blade holder slot along the length of the blade strip.

Figure 8:
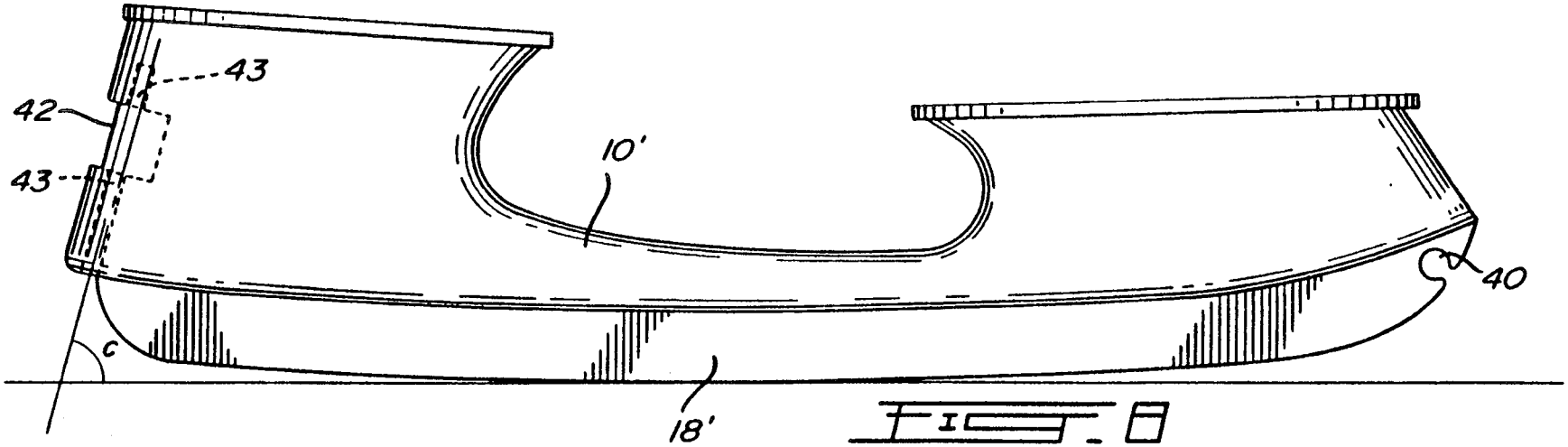
FIG. 8 is a side view of an ice skate assembly without the runner attached thereto.

As can be seen from FIG. 8, the (frontwardly open) angle between bore 43 and the tangent of the central reinforcement 18' (shown as "c" in FIG. 8) may vary over a wide range such as, for example, from about 60 to about 120 degrees; the angle "c" may, more particularly, for example, be greater than 60° and smaller than 90°.

Having now described and illustrated two forms of this invention, it is to be understood that the invention is not to be limited to the specific forms or arrangement of parts shown and described herein.

We claim:

1. An ice skate blade assembly having a holder, said holder having a front end, a runner supporting portion and a rear end, said holder being configured to carry a replaceable runner formed as a flexible strip arranged to be secured to the holder, said runner having a runner front end, an ice contacting portion and a runner rear end, said runner front end, said ice contacting portion and said runner rear end defining a runner length, and a front attachment for releasably securing the runner front end to the front end of the holder, characterized in that said assembly comprises an eccentric lock for releasably securing the runner rear end to the rear end of the holder, said eccentric lock comprising an urging assembly having a first pivot axis and a second pivot axis, said second pivot axis being disposed eccentrically of said first pivot axis, said urging assembly being connected to the holder such that the urging assembly is pivotable about said first pivot axis, and a second hooking member for releasably engaging a first hooking member when said first hooking member is connected to an upwardly extending terminal end part of said runner rear end, said eccentric lock having a lock configuration wherein said second hooking member is able to be releasably maintained in a locking over-center position relative to said first pivot axis such that said runner is longitudinally tensioned along said runner length and an unlock configuration wherein the first and second hooking members are disengageable, said eccentric lock being displaceable between said lock and unlock configurations by displacing said urging assembly about said first pivot axis between a respective lock and unlock position, and said second hooking member being connected to said urging assembly so as to be pivotable about said second pivot axis and so as to be urgeable to and from said locking over-center position when said urging assembly passes between said lock and unlock positions.

2. An ice skate blade assembly according to claim 1, wherein said Urging assembly comprises a latch lever displaceable about said first pivot axis between said lock and unlock positions, and wherein said second hooking member comprises a draw hook having an outer end hook for releasably engaging said first hooking member, said draw hook having an inner end connected to said latch lever such that said draw hook is pivotable about said second pivot axis.

3. An ice skate blade assembly according to claim 2, wherein the latch lever is pivotable within lugs which project rearwardly of the holder, the latch lever having side flanges which extend below said lugs and enclose the sides of said first hooking member when the latch lever is in the lock position.

4. An ice skate blade assembly having a holder, said holder having a front end, a runner supporting portion and a rear end, said holder carrying a replaceable runner formed as a flexible strip arranged to be secured to the holder, said runner having a runner front end, an ice contacting portion and a runner rear end, said runner front end, said ice contacting portion and said runner rear end defining a runner length, a first hooking member being connected to said runner rear end, and a front attachment releasably securing the runner front end to the front end of the holder, characterized in that said runner rear end has an upwardly extending terminal end part to which said first hooking member is attached and in that said assembly comprises an eccentric lock for releasably securing the runner rear end to the rear end of the holder, said eccentric lock comprising an urging assembly having a first pivot axis and a second pivot axis, said second pivot axis being disposed eccentrically of said first pivot axis, said urging assembly being connected to the holder such that the urging assembly is pivotable about said first pivot axis, and a second hooking member releasably engaging said first hooking member, said eccentric lock having a lock configuration wherein said second hooking member is releasably maintained in a locking over-center position relative to said first pivot axis such that said runner is longitudinally tensioned along said runner length and an unlock configuration wherein the first and second hooking members are disengageable, said eccentric lock being displaceable between said lock and unlock configurations by displacing said urging assembly about said first pivot axis between a respective lock and unlock position, and said second hooking member being connected to said urging assembly so as to be pivotable about said second pivot axis and so as to be urgeable to and from said locking over-center position when said urging assembly passes between said lock and unlock positions.

5. An ice skate blade assembly according to claim 4, wherein said urging assembly comprises a latch lever displaceable about said first pivot axis between said lock and unlock positions, and wherein said second hooking member comprises a draw hook having an outer end hook releasably engaging said first hooking member, said draw hook having an inner end connected to said latch lever such that said draw hook is pivotable about said second pivot axis.

6. An ice skate blade assembly according to claim 5, wherein the latch lever is pivotable within lugs which project rearwardly of the holder, the latch lever having side flanges which extend below said lugs and enclose the sides of said first hooking member when the latch lever is in the lock position.

7. An ice skate blade assembly according to claim 6, wherein a portion of said terminal end part is bent away from the rear end of the holder so as to define said first hooking member.

8. An ice skate blade assembly according to claim 4, wherein the holder comprises an upper portion formed of plastic and a lower reinforcement portion which is formed of material stronger than said plastic, said holder lower portion providing a locating surface for said runner, and said holder lower portion being disposed between said runner and said holder upper portion.

9. An ice skate blade assembly according to claim 4, wherein said front attachment comprise a bent over portion in the runner front end engageable with the front end of said holder.

10. An ice skate blade assembly according to claim 9, wherein said bent over portion includes a rearwardly extending end portion engageable in a recess in the front of the holder.

11. An ice skate blade assembly according to claim 4, wherein the upwardly extending terminal end part has a longitudinal axis, and wherein said longitudinal axis and a tangent drawn relative to the ice contacting portion define an angle greater than 60° and less than 90°.

12. An ice skate blade assembly according to claim 4, wherein said runner and said holder runner supporting portion have mating tongue and groove means interlocked along said runner ice contacting portion.

13. An ice skate blade assembly according to claim 12, wherein said runner has a main part surmounted by a rib, the dimensions of said main part being of the order of 3.17 mm wide and 1.6 mm deep.

* * * * *